US010934788B1

(12) United States Patent
Perry et al.

(10) Patent No.: US 10,934,788 B1
(45) **Date of Patent: *Mar. 2, 2021**

(54) METHOD AND APPARATUS FOR REMOVING GAS FROM MULTIPLE GAS PRODUCING ZONES IN A WELLBORE

(71) Applicant: I.P. CO, LLC, Denver, CO (US)

(72) Inventors: Michael S. Perry, Denver, CO (US); Gerald Luken, Gillette, WY (US); Cory Luken, Gillette, WY (US)

( * ) Notice: Subject to any disclaimer, the term of this patent is extended or adjusted under 35 U.S.C. 154(b) by 84 days.

This patent is subject to a terminal disclaimer.

(21) Appl. No.: 16/212,071

(22) Filed: Dec. 6, 2018

Related U.S. Application Data

(63) Continuation-in-part of application No. 15/355,929, filed on Nov. 18, 2016, now Pat. No. 10,633,963.

(51) Int. Cl.
*E21B 17/18* (2006.01)
*E21B 33/12* (2006.01)

(52) U.S. Cl.
CPC ..... *E21B 17/18* (2013.01); *E21B 33/12* (2013.01)

(58) Field of Classification Search
CPC ..... E21B 43/08; E21B 43/082; E21B 43/084; E21B 43/086; E21B 43/088; E21B 43/34; E21B 43/36; E21B 43/38; E21B 43/385
See application file for complete search history.

(56) References Cited

U.S. PATENT DOCUMENTS

| | | | | |
|---|---|---|---|---|
| 2,877,852 | A * | 3/1959 | Bashara | E21B 43/08 166/236 |
| 5,673,752 | A | 10/1997 | Scudder et al. | |
| 6,228,146 | B1 * | 5/2001 | Kuespert | B01D 61/00 166/105.5 |
| 2011/0011586 | A1 * | 1/2011 | Dusterhoft | E21B 43/08 166/278 |

* cited by examiner

*Primary Examiner* — David Carroll
(74) *Attorney, Agent, or Firm* — Reilly Intellectual Property Law Firm

(57) ABSTRACT

A method and apparatus for removing dissolved gas from multiple levels of a coal bed or other type of gas bearing formations is provided.

17 Claims, 7 Drawing Sheets

REPLACEMENT SHEET

METHOD AND APPARATUS FOR REMOVING GAS FROM MULTIPLE GAS PRODUCING ZONES IN A WELLBORE

FIELD

The present method and device relates to natural gas (gas) extraction from wells. In particular, it relates to a method and apparatus for passive recovery of natural gas from multiple levels of substrate in the subsurface.

BACKGROUND

Removal of gas from gas producing formations is generally accomplished by separating gas from liquids present in the formations either in wellbore or at the surface. For example, coal bed methane is a form of natural gas that can be extracted from coal bed formations. Coal bed methane is methane gas that is contained in coal seams as a result of biological, chemical and physical processes. Methane is adsorbed into the matrix of the coal and lines the inside pores within the coal. It is often produced at shallow depths through a bore hole that allows gas and water to be produced.

Extraction of coal bed methane, (a type of natural gas), is known in the prior art and generally, to extract methane, a steel encased hole is drilled into the coal seam of less than 300 to over 4,920 feet below the surface of the ground. As the pressure within the coal seam declines due to pumping and removal of water from the coalbed, both gas and water can surface through the pump tubing. More commonly, formation water is extracted through the tubing and the isolated coal bed methane gas travels upwardly thru the casing of the wellbore and is collected at the surface. The gas is generally sent to a compressor station and into natural gas pipelines. The formation or produced water is either reinjected into isolated wells, or if it does not contain contaminants, released into streams, used for irrigation, or sent to evaporation ponds. The formation water typically contains dissolved solids such as sodium bicarbonate and chloride but its chemistry will vary depending upon the geographic location of the well.

The production of coal bed methane from formations is typically characterized by a negative decline in which the gas production rate initially increases as the water is pumped off and gas begins to desorb and flow. Desorption is the process by which coals free methane when the hydrostatic pressure in the coal formation is reduced. The methane desorption process follows a curve (of gas content vs. reservoir pressure) called a Langmuir isotherm. The isotherm can be defined by a maximum gas content (at infinite pressure), and the pressure at which half that gas exists within the coal. These parameters (called the Langmuir volume and Langmuir pressure, respectively) are properties of the coal, and vary widely depending upon the physical and chemical characteristics of the coal and the geographic location. As gas production occurs from a coal reservoir, the changes in pressure are believed to cause changes in the porosity and permeability of the coal. This is commonly known as matrix shrinkage/swelling.

Many coal bed methane producing formations have been drilled and abandoned or drilled and shut in, leaving orphaned wells that still possess gas pressure. As an alternative to the pumping of water off of the coals to produce gas or plugging and reclaiming wells, the alternate forms provide an apparatus and method for continued recovery of coal bed methane from coal bed methane formations without the cost and need of releasing or removing formation water. In addition, there are many shallow gas wells which produce gas from rock types other than coal in which the hydrostatic head of the produced water is greater than the gas bearing formations reservoir pressure. All versions of the current apparatus will also allow gas to be produced in these formations and wells. Finally, the current tools will allow for processing of multiple gas bearing zones in the wellbore simultaneously contributing to the total productive gas volume of the well.

In accordance with the disclosure, there is provided a gas isolation tool for insertion in a cased wellbore drilled thru gas bearing formation(s), the casing having an upper open end, the tool comprising a cylindrical multi-part housing with upper and lower open ends, at least one end attached to production tubing, the housing having an internal cavity sized to accommodate a perforated cylindrical internal tool, a mesh liner, a hydrophobic sleeve member and a by-pass gas transport tubing member, and in certain applications, a perforated or slotted boretail secured to the housing and the tool having upper and lower production tubing engaged with casing swedges secured to the upper and lower open ends. The bypass production tubing transport member is adapted to transport gas for commingling with gas removed from gas bearing strata at different depths in the wellbore and includes a ring member and a lower base member secured to a tubing member which is secured within the hydrophobic sleeve member. The tubing extends a substantial length of the sleeve member and is coextensive and inside the mesh member and the hydrophobic sleeve member.

In accordance with the disclosure, there is also provided a gas isolation tool for insertion in a cased wellbore drilled thru a gas bearing formation, the casing having an upper open end, the tool comprising a cylindrical pipe or housing with upper and lower open ends, at least one end attached to production tubing, the housing having a perforated shell, a hydrophobic member which is then wrapped in stainless steel mesh which is secured tightly to the hydrophobic member and pipe. To maintain the tool position in the middle portion of the cased wellbore, centralizers will then be attached to the outside of the stainless steel mesh, and the tool having upper and lower production tubing to casing swedges secured to the upper and lower open ends.

A method of separating natural gas from formation rock types and formation water in a gas producing well is also included, the steps comprising, introducing an isolation tool within a casing of a gas formation, one tool having connected first and second separator sections each having internal cavities, the tool including a bypass gas transport, facilitating gas passage through the bypass, directing reservoir fluid upwardly into the second separator section of the isolation tool and limiting flow of solids into the second section with spaced perforations on the second separator section, limiting the passage of formation fluid through a sleeve member, allowing passage of gas thru the sleeve member, a mesh member and a perforated tool insert and into an annulus of the tool insert, gathering isolated gas into tubing for passage into surface gas gathering pipelines, and maintaining formation fluid within the well. A method of separating gas from formation rock types and water in a gas producing well in another form of tool, the steps comprising introducing an isolation tool within a casing of a gas formation, the tool having a protective member with upper and lower open ends and an internal cavity sized to accommodate a perforated cylindrical pipe having upper and lower open ends and a hydrophobic member, filtering of the gas/formation waters with the cylindrical pipe and the hydrophobic membrane, creating a pressure sink within an annulus of the tool, gathering the gas into tubing for passage into a gas gathering member, maintaining formation fluid within the well, and off-setting the protective member from a casing within the wellbore with at least one centralizer.

BRIEF DESCRIPTION OF THE DRAWINGS

The accompanying drawings, which are incorporated and which constitute a part of the specification, illustrate at least one embodiment of the present device.

DETAILED DESCRIPTION

Figure 1:
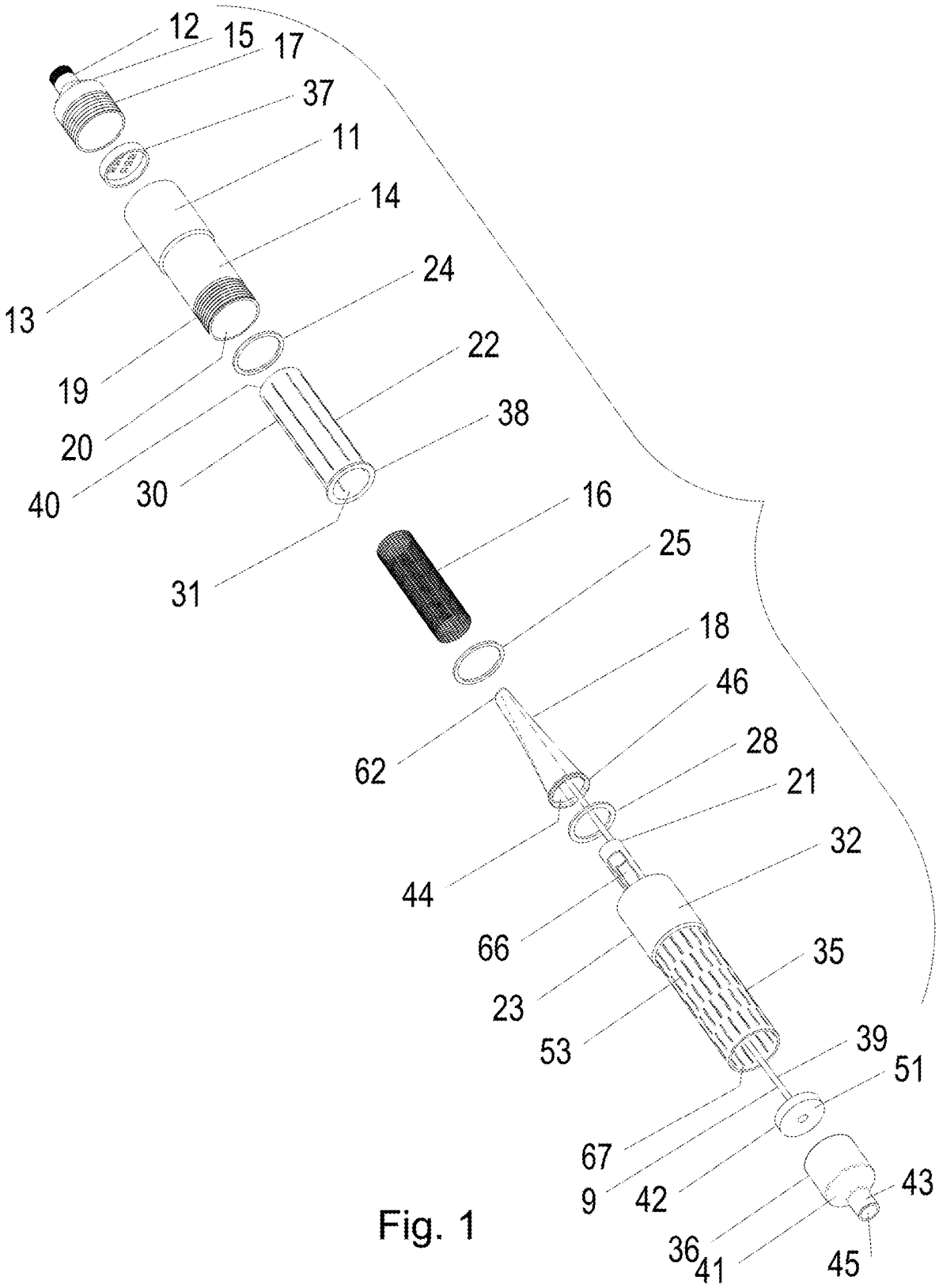
FIG. 1 is an exploded view of one form of gas recovery tool.
Figure 2:
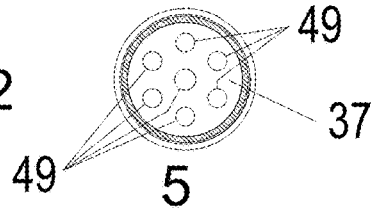
FIG. 2 is a cross-sectional view about lines 2-2 of FIG. 3.
Figure 3:
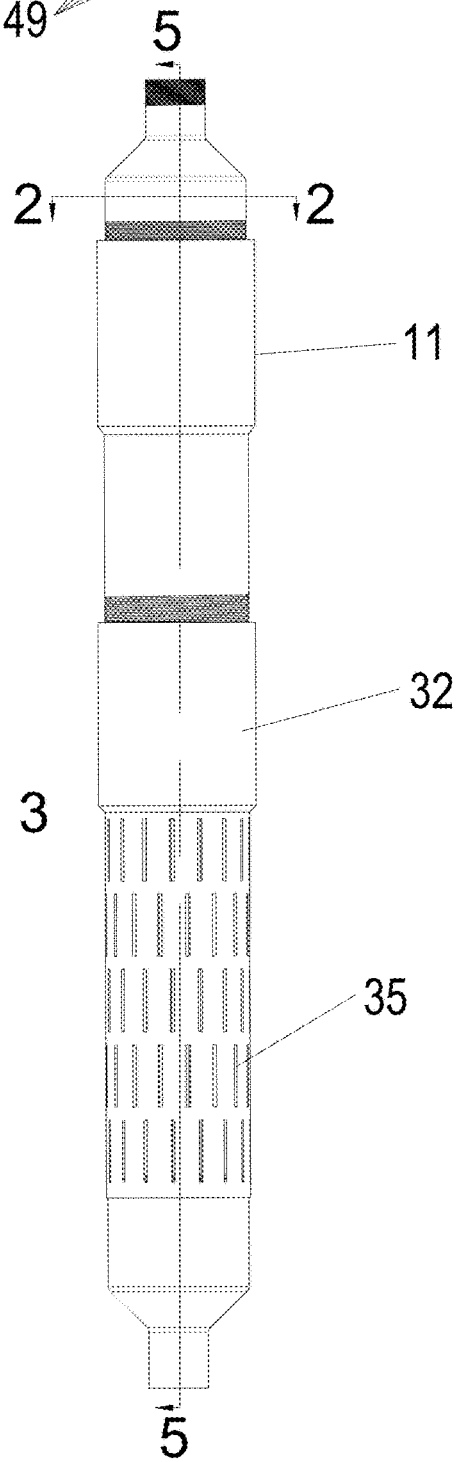
FIG. 3 is a perspective view.
Figure 4:
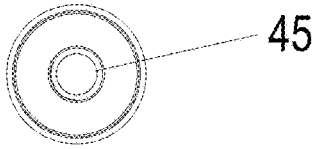
FIG. 4 is a bottom view of FIG. 3.

A first form of a wellbore gas isolation device 10 is provided and shown in FIGS. 1-6. More specifically, the device 10 has an upper section of the tool 13 with an external housing 11 which is of cylindrical configuration having an upper neck coupling or swedge 12, collar 15 and lower threads 17. The housing 11 includes interior threads for engagement with lower threads 17, a circumferential housing 14 with threads 19, an optional aluminum or steel compression ring 24, a perforated cylindrical internal tool insert 22 with a steel ring 38, a wire mesh screen 16, an optional second compression ring 25, a hydrophobic sleeve member 18 with an aluminum flange ring 46, an aluminum separator seal locking ring 28 and a gas/water internal separator support 21 having a baffle plate (not shown). The lower portion of the tool has compartment member 32 for threaded connection with the housing 14, a perforated boretail 35, a lower swedge 36, collar 41 and neck 43 with opening 45.

Figure 5:
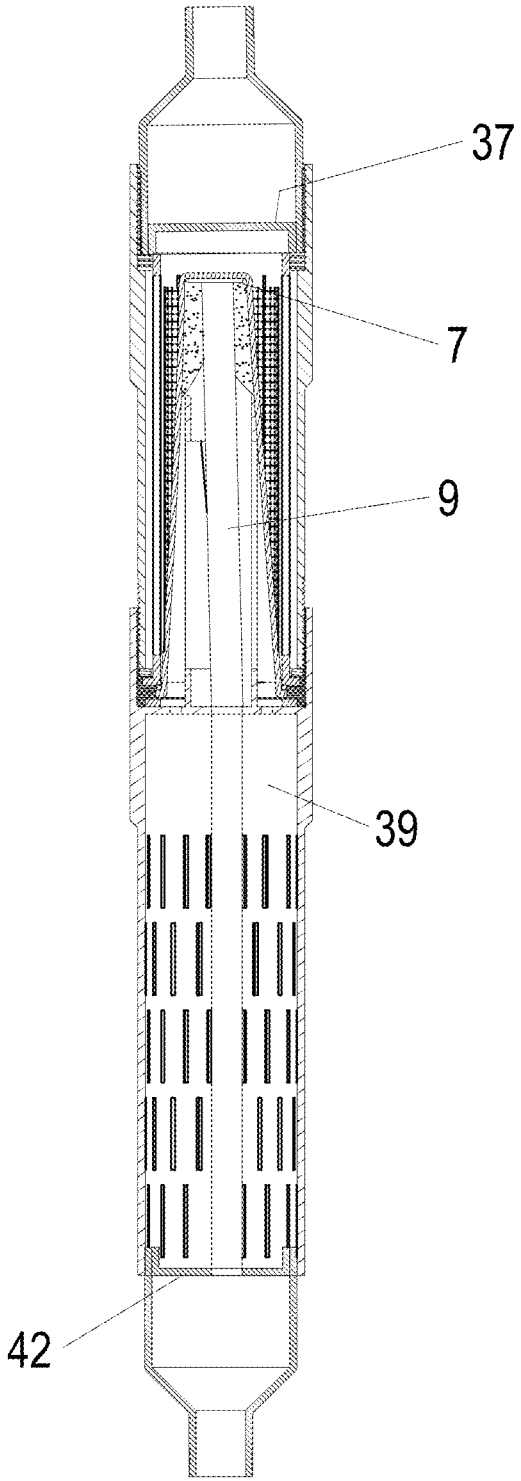
FIG. 5 is a cross-sectional view about lines 5-5 of FIG. 3.

Contained within the upper section 13, compartment member 32 and boretail 35 is by-pass gas transport member 39 that includes tubing member 9 with a lower plate 42 and a support ring member 7, as shown in FIG. 5. The by-pass tubing 9 is preferably formed of metal but may also be formed of poly-pipe. The tubing 9 is inserted into both the bottom or lower plate 42 with opening 51 and the ring member 7. The lower plate 42 is preferably formed of metal but may also be made up of poly-pipe or any other type of rigid, non-corrosive substance.

The tool described herein consists of a break down tool that may be assembled to a length of at least 2' to 40' or longer. The components are of shorter length to provide for easy manufacturing, transport and assembly on site. The components are also easily disassembled with a multitude of threaded members. The threaded members are an alternative to use of bolts and other securing mechanisms that may easily fail or corrode over time. The extended length provides additional surface area for gas/water separation allowing for a more efficient separation. The shortened length allows for multiple tools as described to be connected and placed within a single gas formation.

Figure 6:
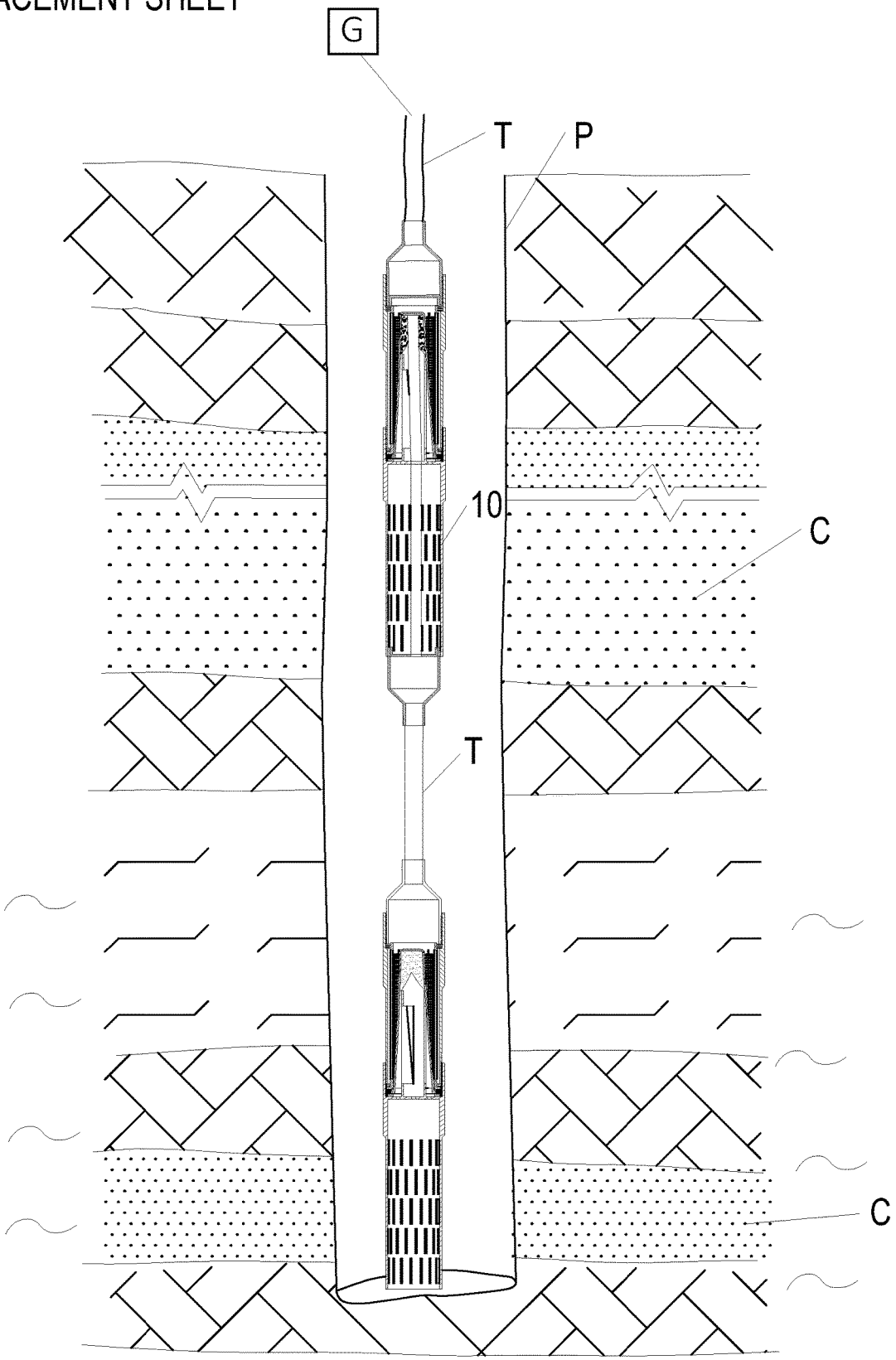
FIG. 6 is a sectional view as shown in FIG. 3 including a sectional view of a gas producing formation.

The tool 10 is designed to be positioned within a cased well bore C as shown in FIG. 6. The tool 10 preferably comprises the exterior housing 11 that is made up of 2' to several feet in diameter steel or other non-corrosive material, ranging in length from 2 feet and up to 40 feet and beyond depending upon the diameter of the wellbore and reservoir characteristics of the gas bearing formations. An upper section of the tool 13 has the external housing 11 which is of cylindrical configuration having the upper neck coupling or swedge 12 and upper plate 37 with gas slots 49 present for passage of gas therethrough. The upper plate 37 is preferably formed of metal but may also be made up of poly-pipe or any other type of rigid, non-corrosive substance and is preferably welded to the swedge 12. There is collar 15, lower threads 17, the solid housing 11 includes interior threads for engagement with lower threads 17, cylindrical wall housing 14 with exterior threading 19 is designed to house interior gas separation elements. The upper section 13 as well as lower section 23 are preferably made up of non-corrosive steel or aluminum.

Figure 7:
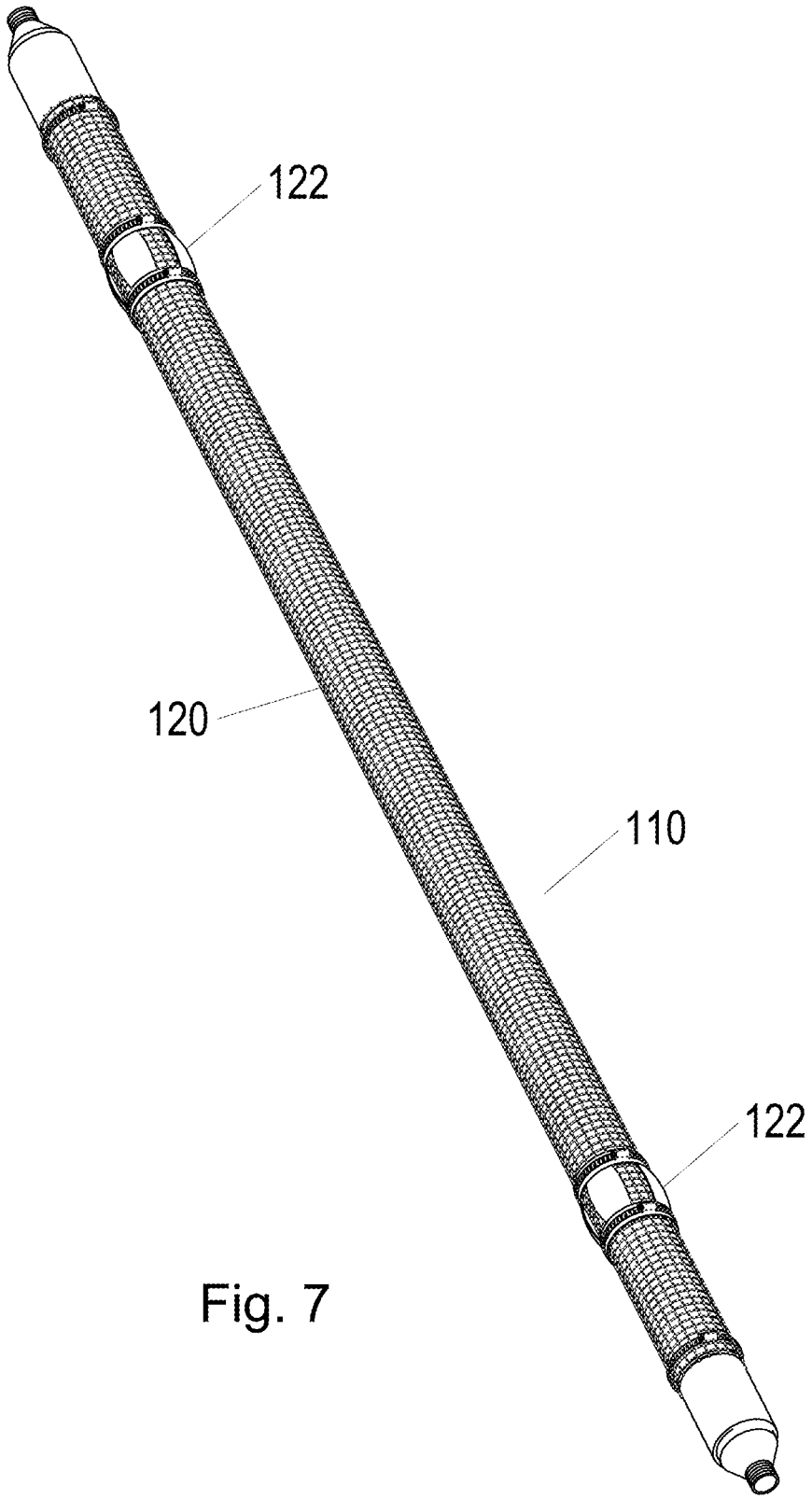
FIG. 7 is a perspective view of another form of gas recovery tool.

As shown in FIGS. 1-6, the upper section 13 includes an internal cavity or annulus 20. The collar 15 is circumferentially positioned around the swedge 12. The swedge 12 which includes upper plate 37 is designed to be positioned below the static water level in the wellbore and allows gas to flow up the tubing T to gas removing, gathering and sales pipelines G or connection with another tool 10 for gas recovery from different zones as shown in FIG. 7. The tubing T is threaded into the swedge 12. The internal tool annulus 20 and the housing 14 are sized to accommodate the perforated tool insert 22 and the by-pass gas transport member 39. The tool insert 22 is defined preferably by cylindrical walls of 4" aluminum having circumferentially aligned, radially spaced perforations 30, preferably along the entire length of the tool insert, an internal cavity 31 and the outwardly extending rim member or ring 38 having an opposite open end 40 from the rim member 38.

One end of the housing 14 has internal threads for connection to the housing 11 and swedge 12 and lower threaded members 19 for threaded attachment to lower compartment member 32. As mentioned above, the exterior housing 11 is designed to house tool insert 22, as shown in FIGS. 1 and 5, with the tool insert 22 defined by a longitudinally slotted circumferential housing having perforations 30 at radially spaced intervals. The perforations or slots are preferably ⅛", and 20¾" length at 45 degrees of one another, depending upon the length of the tool. The perforations will vary depending upon the type of solids present in the gas formation reservoir. The tool insert 22 is preferably made up of non-corrosive steel, aluminum, polypipe, plastic or other suitable material, with any size diameter from 2" to over several feet as long as it will fit into the housing 14 but this may vary depending upon the desired length of the tool 10. The slots aid in gas separation as well as water/solid separation. A stainless-steel screen 16, matching the length and having a slightly smaller interior circumference than the tool insert 22, is inserted in touching relation within the interior of the tool insert 22. The screen cage 16 may be inserted within the internal cavity 31 to line the interior cylindrical walls in touching relation to the perforations 30. The mesh screen is preferably 10 mesh, stainless steel but can be of different composition and still be within the scope of this disclosure.

A gas/water hydrophobic sleeve 18 is placed over a support shell 21, the support shell 21 providing interior support for the separation tool/sleeve 18 and preventing it from collapsing within the isolation tool 10. The sleeve 18 includes a cylindrical rim member 46 that maintains the position of the sleeve member within the tool 10. The tool insert 22 in conjunction with steel compression rim ring 38, aluminum or steel compression ring 25, flange ring 46 and aluminum locking ring 28 ensure a tight connection within the tool as shown in FIG. 1. The sleeve member 18 is preferably made up of hydrophobic material having a single open end 44, closed end 62, and the cylindrical rim member 46 for lower support. The preferred material for the sleeve member 18 is polypropylene but may be comprised of any other hydrophobic fibers such as polyester, nylon, or polypropylene. These fibers may be in the form of staple yarns, flat continuous multi-filaments, or texturized continuous multi-filaments. The hydrophobic nature of the sleeve may also be accomplished using hydrophobic and super hydrophobic coatings such as polymethylhydrosiloxane (PMHS) and polyvinyl chloride (PVC), as an example. The sleeve member is preferably of 1 micron pore size but may also be in the range of 0.6 to 1.1 micron pore size to allow for passage of vaporized gas. The sleeve member 18 is inserted into the cavity 31 of tool insert 22 with the mesh screen 16 located therebetween. The placement of the mesh wire screen 16 between the interior of the tool insert 22 and the sleeve member 18 prevents the sleeve member 18 from passing through the perforations 30.

The gas/water internal separator support 21 is adapted for insertion within the sleeve member 18 and comprising any size from 1" up to several feet in diameter as long as it will fit inside the hydrophobic sleeve 18 and then inside of tool insert 22. Slots 66 are cut every 10 to 60 degrees and are at least or greater than 50% of the total length of support 21. The separator support shell 21 is secured, preferably welded, to a baffle plate (not shown) that is welded to the compartment member 32. The baffle plate 71 has radially aligned perforations that aid in gas/water separation as well as blocking of large debris from passing therethrough.

The by-pass gas transport 39 is designed to extend the length of the hydrophobic sleeve member 18 and preferably includes the bottom plate 42, the by-pass tubing 9 and the ring member 7 that is located at the apex of the sleeve member 18. The tubing 9 preferably consists of small diameter tubing that is inserted within the center of the tool 10 and within the interior of the sleeve member 18 as well as the support 21. The tubing end 5 terminates at the ring member 7 which is located along the upper portion 8 of the sleeve member 18. The ring member 7 is slightly smaller in diameter than the upper portion 8 of the sleeve member 18, allowing for a close fit within the sleeve member. The by-pass transport 39 isolates and carries gas from lower zones in the reservoir, through the tool 10 within the sleeve member 18 so it is interior of the gas-water separation chamber and the isolated gas is commingled with the gas separated from the fluid in the tool 10. The bottom plate 42 of the by-pass gas transport is welded to the swedge 36 and the tubing member 9 is threaded along the interior of the boretail 35 and the sleeve member 18.

The boretail 35 is of cylindrical configuration with circumferential perforations 53 and having a lower opening 67, acting as a solid separation tool. The perforations 53 are sized to allow passage of liquid therethrough but prevent passage of large solids into internal opening or cavity of the bore tail. The dimensional length of each portion of the tool is designed to allow fluid to travel the length of the lower and upper sections to allow for separation of the gas from the production fluid. Preferably, the upper and lower sections 13, 23 are of roughly the same length but variations in dimensions are possible without departing from the scope of the disclosure. Additional form, shown in FIG. 6, demonstrate use of a variation of the above tool with substitution of solid housing 54 for the boretail 35. The solid housing 54 has dual threaded members 56 and 58 and is secured to compartment member 32 with the threaded member 56 and to lower swedge 36 with the threaded member 58.

Another form of wellbore gas isolation device 110 is provided and shown in FIGS. 7-11. More specifically, the tool 110 comprises a series of wrapped cylindrical materials. A longitudinally slotted circumferential housing or pipe 112 having perforations 114 at radially spaced intervals is preferably made of highly perforated polyethylene pipe. The pipe 112 may have a diameter in a range of 2" to over 12" depending upon the size of the cased wellbore. The diameter of the pipe 112 must be less than that of the cased wellbore so that the tool 110 may be inserted within the wellbore. The perforations 114 are preferably evenly spaced and are located along the entire length of the pipe 112.

Figure 8:
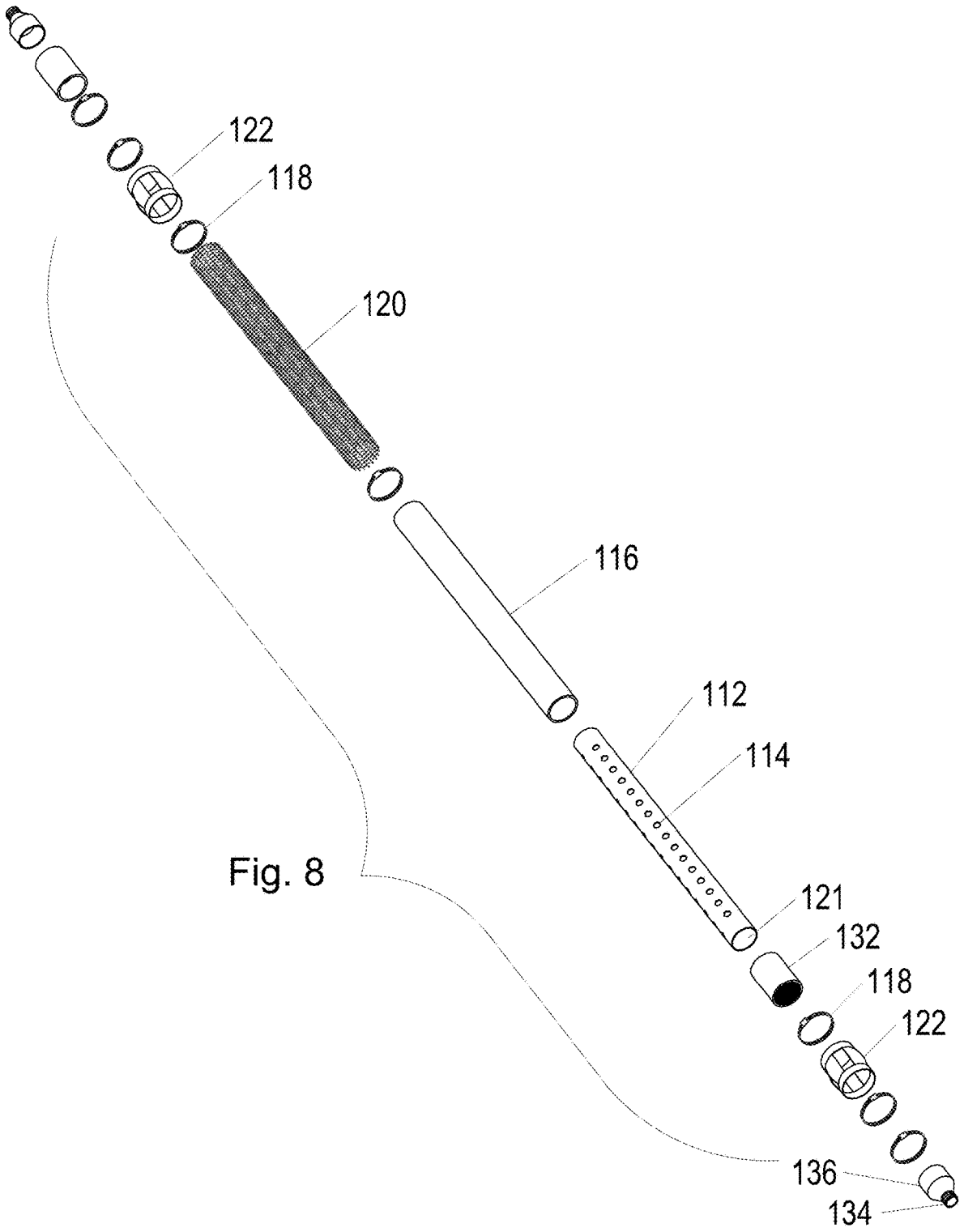
FIG. 8 is an exploded view of FIG. 7.
Figure 9:
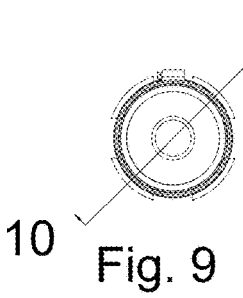
FIG. 9 is a view from the top and bottom of FIG. 7.
Figure 10:
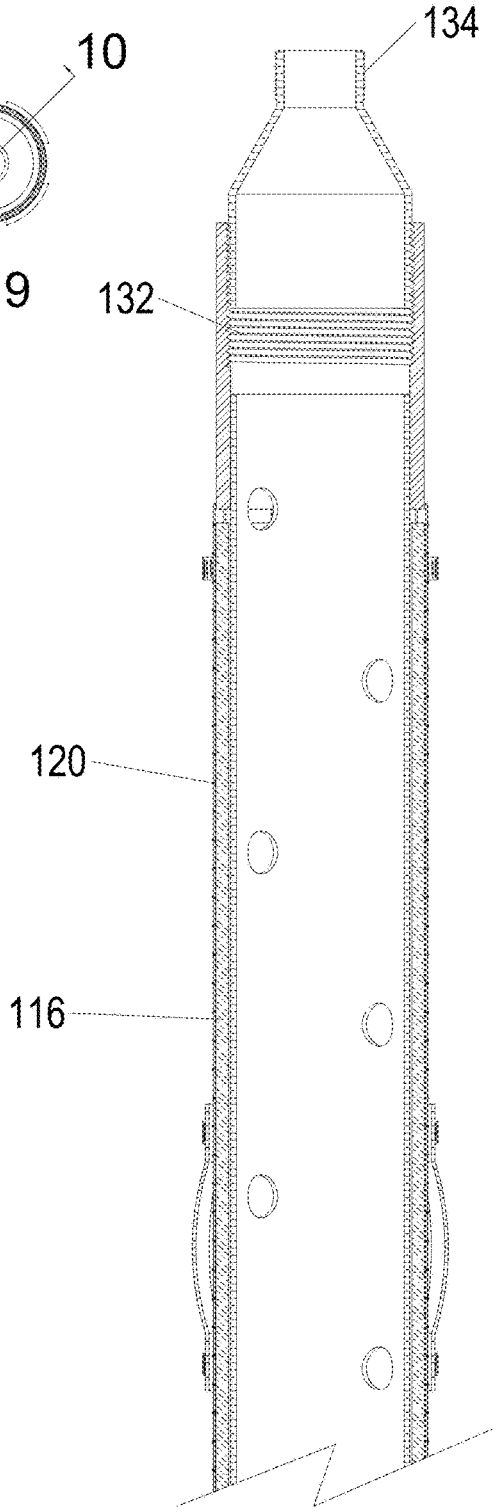
FIG. 10 is a partial cross-sectional view about lines 10-10 of FIG. 9.
Figure 11:
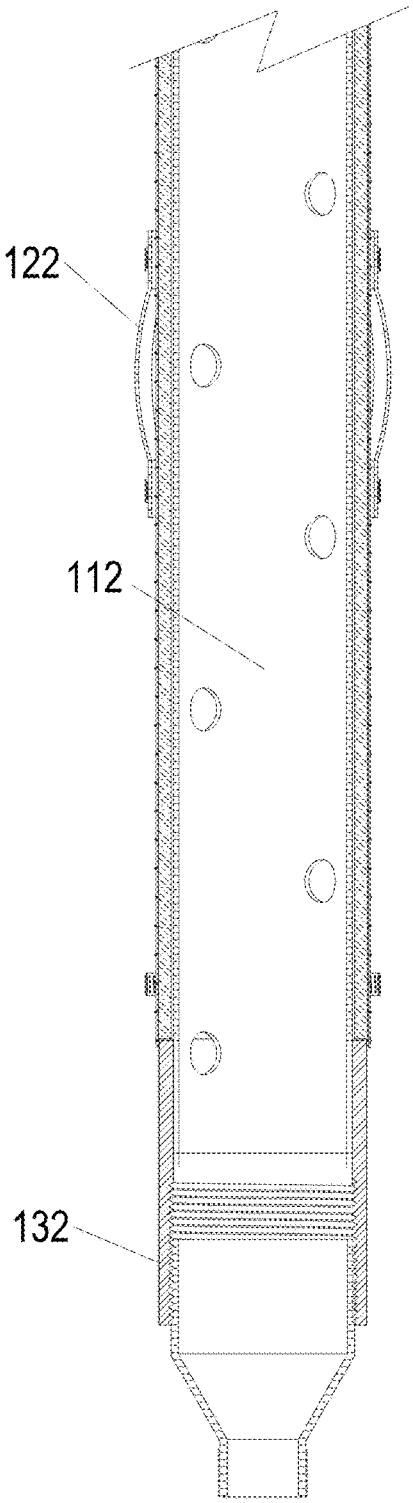
FIG. 11 is a partial cross-sectional view about line 10-10 of FIG. 9.

Exterior to the pipe 112 is a hydrophobic membrane 116 which is co-extensive with the pipe 112 and is secured at opposite ends of the membrane 116 to the pipe 112 with a clamping member 118 as shown in FIG. 8. The gas/water hydrophobic sleeve 116 includes dual open ends 117, 119 and is preferably made up of hydrophobic material such as polypropylene but may be comprised of any other hydrophobic fibers such as polyester, nylon, or polypropylene. These fibers may be in the form of staple yarns, flat continuous multi-filaments, or texturized continuous multi-filaments. The hydrophobic nature of the sleeve may also be accomplished using hydrophobic and super hydrophobic coatings such as polymethylhydrosiloxane (PMHS) and polyvinyl chloride (PVC), as an example. The sleeve member is preferably of 1 micron pore size but may also be in the range of 0.6 to 1.1 micron pore size to allow for passage of vaporized gas.

The sleeve member 116 is placed over the pipe 112 and exterior to the hydrophobic member is a protective member 120 made up of stainless steel mesh, preferably #10 mesh, which protects the hydrophobic membrane 116 from wear and tear during transportation and insertion/removal from the wellbore while also allowing passage of water. The placement of the hydrophobic sleeve member between the protective member 120 and the pipe 112 allows passage of gas through the perforations 114 and into the annulus 121 without water or solids passing into the annulus 121 as well. The stainless-steel screen 120, matching the length and having a slightly larger interior circumference than the pipe 112, is preferably 10 mesh stainless steel but can be of different composition and still be within the scope of this disclosure.

The protective member 120 is co-extensive with the hydrophobic membrane 116 and is clamped or secured to the exterior of the hydrophobic membrane 116 with metal clamps 118. Additionally, there are several centralizers 122, preferably at least 2, which are secured to the exterior surface of the wire mesh. The centralizers 122 may be made of a variety of materials, i.e., poly, steel, aluminum without departing from the scope of the disclosure. The form of the centralizers can also be highly variable, but in order to function properly, the form must have an extending surface that provides a space between the casing of the wellbore and the protective member 120. The form of the centralizers 122 provides stabilization and centralization of the tool within the wellbore. The centralizers 122 prevent the tool from leaning or being pushed up against the inside of the cased wellbore, which can decrease the surface area of the hydrophobic membrane 116 that is in contact with gas saturated water in the wellbore.

A single tool 110 can be run on the lower end of the production tubing if the well is only completed in a single zone. In this case a cap (not shown) would be fused/attached to the base of poly cylinder to prevent formation water from entering the tool and possibly traveling uphole into the tubing. Multiple tools 110 can be run adjacent to one another or separated by several feet or several 100's of feet in the wellbore simply by replacing the basal cap with a poly to steel (with threads) transition 132, swedge 136 and placing a threaded nipple 134 between the two attached tools 110 (for adjacent tools) or X feet of tubing for tools 110 spaced a pre-determined distance apart.

In use, the tool 10 or tool 110 may be transported as separate parts and assembled on-site and set below the static water level in the wellbore. Multiple tools may be inserted within a single casing. Due to the potential length of the tool, it may be more cost effective and easier to assemble on site. Referencing tool 10, the lower section 23 of the tool 10 receives gas combined with formation liquid from the well reservoir through the encased well bore. The boretail 35 restricts large solids from entering the bore tail passageway due to the restrictive perforations 55. The perforations may have a range of size due to conditions within the gas reservoir. For example, a reservoir that sheds particulate matter into the wellbore that is smaller in size, such as sand, will have smaller perforations. A tool set within a reservoir that sheds or gives up larger rocks or coal will have larger perforations to block passage of larger material without preventing the passage of water and gas. A mixture of gas and liquid is generated within the boretail 35 with the pressure forcing the mixture through the baffle plate and into the upper section 13 of the tool 10. The addition of the gas transport member 39 allows simultaneous collection of gas from multiple layers of gas formations. The tool 110 is primarily used in cased wellbores in which the solids present in the formation waters are minimal.

Both tool 10 and tool 110 work as described below; If one tool is set one hundred feet below the static fluid level in the wellbore this creates a hydrostatic pressure of approximately 43 psi at this depth under fresh (non-salt) water inside of the cased borehole. The tubing T and both the tool 10 and tool 110 having annulus 20 and 121 are isolated from the approximately 43 psi of hydrostatic pressure by the hydrophobic sleeve membrane 18 and 116. The tubing pressure (and pipeline pressure) are preferably maintained at 5 psi to 20 psi, or at any pressure that is less than the hydrostatic pressure at the depth in the wellbore that the tool is set. This creates a pressure sink in annulus 20 and 121 of the difference between the approximately 43 psi hydrostatic head and pressure inside the annulus 20 and 121; tubing T and the surface gas pipelines (not shown). For example, if the tubing T pressure is 10 psi, the pressure differential is 33 psi ((43 psi (hydrostatic head)−10 psi (tubing T pressure)). The side of the hydrophobic membrane 18 and 116 in contact with the formation water is set at a depth in the wellbore such that the hydrostatic pressure at that depth is greater than the pressure on the side of the hydrophobic membrane that is in contact with the annulus 20 and 121 that connects to the production tubing that runs up to the surface.

In tool 10 the wire mesh is on the gas side of the hydrophobic membrane 18 and in tool 110 the wire mesh is on the water side (outside) of the hydrophobic membrane 116. In both tools, the wire mesh provides support and protection for the hydrophobic membrane. In tool 10, the gas travels through the hydrophobic membrane 18 and then travels upwardly through the annulus 20 into the production tubing to the surface. In tool 110, gas through the hydrophobic membrane 116 to the interior surface of the membrane 116 and upwardly through the annulus 121 of the tool to the production tubing to the surface.

By its very nature, gas will flow towards a point of lowest pressure in the wellbore. The gas dissolved in the coal (or other rock type) formation or production water will flow towards the pressure sink. The addition of the tool 10 or 110 allows gas from the additional gas bearing strata in the wellbore to be separated from the water in the wellbore, then into the tubing for transport to the surface and then thru gas pipelines to gas sales. In the case of the tool 10, insertion of small diameter tubing through the interior of the hydrophobic membrane or sleeve allows for capture and isolation of gas from lower zones for eventual comingling with gas separated from fluid in the standard tool. In this way, tubing T may be threaded into the collar on the top of the stacked tool and threadedly connected to the bottom swedge of an uphole tool as shown in FIG. 6. In the case of the tool 110, formation waters are always on the outside of the tool and hydrophobic membrane, so a bypass tubing is not required. There may be situations where tool 10 and tool 110 can be used in the same wellbore.

If the tool 10 is used, fluid will flow upwardly into the boretail 35 with the perforations 55 blocking solids from entering the tool. The fluid travels upwardly and passes through the baffle plate which further aids in filtering out solids. The fluid then passes through the sleeve member 18, mesh screen 16 and perforated tool insert 22 as discussed previously. The gas is liberated from the fluid or water within the interior of the sleeve member 18, passes through the hydrophobic membrane 18, the mesh cage 16, the tool insert perforations 30 and into the tool annulus 20. Additional gas from tubing T will pass through bottom plate 51, through tubing 9 and ring member 7 then passing through hydrophobic membrane 18 and commingles with the liberated gas. The liberated gas plus the by-pass gas then travels upwardly through the tool and up the tubing T into at least one additional tool 10 for additional gas collection or to a gas gathering pipeline. The addition of at least one tool 10 into the casing allows multiple gas bearing zones in the wellbore to simultaneously produce and contribute to the wells total productive gas volume. There are situations where the gas bearing strata are separated by hundreds or thousands of feet in the cased well bore. In these instances, the casing is typically perforated across this gas bearing strata and often there are many gas bearing zones in a single wellbore. The introduction of additional tools 10 will enable multiple gas bearing zones to be produced simultaneously with a minimal amount of inter-zonal interference using the by-pass gas transport member. Further, the gas produced within the tool will be in addition to the gas that has already been separated from other gas bearing zones lower in the wellbore either by a standard gas separation tool or another tool as described herein.

Formation fluid or water remains within the interior of the tool and generally is not forced upwardly into the tubing T due to the hydrophobic sleeve 18. Under certain conditions, the rock formations already possess liberated gas and it is not necessary to pump or remove de-gassed formation fluid. If desired, the by-pass transport member may be rendered inoperative by plugging opening 51. In this form, gas from a single strata layer may be removed from the reservoir with a single tool.

While the present method and apparatus have been described in connection with the illustrated embodiments, it will be appreciated and understood that modifications may be made without departing, from the true spirit and scope.

We claim:

1. A gas isolation tool for insertion in a cased wellbore of a gas bearing formation, the casing having an upper open end, the tool comprising;

a cylindrical multi-part housing with upper and lower open ends;

said housing having an internal cavity sized to accommodate a perforated cylindrical internal tool, a hydrophobic sleeve member having a distal open end and a proximal closed end, and a by-pass gas transport member;

a perforated boretail secured to said housing; and said tool having at least one swedge secured to at least one of said upper and lower open ends.

2. The tool according to claim 1 wherein said sleeve member has a flange ring and an inner support shell.

3. The tool according to claim 2 wherein said housing accommodates a mesh liner that is co-extensive with said internal tool and said sleeve member.

4. The tool according to claim 1 wherein said by-pass gas transport member includes an upper ring member and a lower base member secured to a tubing member.

5. The tool according to claim 4 wherein said by-pass gas transport member is located within said sleeve member and said upper ring member has a diameter that is less than the diameter of a closed end of said sleeve member.

6. The tool according to claim 5 wherein said tubing is coextensive with said support shell and said sleeve member.

7. The tool according to claim 6 wherein said tubing extends at least 50% of a length of said sleeve member.

8. The tool according to claim 1 wherein an upper swedge includes a top plate with spaced slotted openings.

9. The tool according to claim 4 wherein said lower base member is secured within a lower swedge.

10. The tool according to claim 1 wherein said bypass transport member is configured to transport gas for commingling with gas removed from a different strata.

11. An isolation tool for capture of gas from formation rock, comprising:

an external cylindrical housing, a slotted cylindrical internal tool insert, a circumferentially spaced wire cage aligned in touching relation to said tool insert, a hydrophobic sleeve member having a distal open end and a proximal closed end, a ringed support member, a by-pass transport member co-extensive with said sleeve member and a perforated boretail with a lower open-ended swedge.

12. The isolation tool according to claim 11 wherein said tool comprises upper and lower isolation sections with the upper isolation section defined by a housing with an interior annulus for housing said internal tool insert and said by-pass transport member.

13. The isolation tool according to claim 10 wherein said by-pass transport member extends at least 50% of a length of said sleeve member.

14. The isolation tool according to claim 10 wherein said upper section includes the external housing which is of cylindrical configuration having an upper neck coupling, an upper perforated plate, cylindrical walls and threaded openings.

15. The isolation tool according to claim 11 wherein said swedge is configured to be positioned below a water level and allows gas removal tubing to pass therethrough from a secondary isolation tool.

16. The isolation tool according to claim 11 wherein said tool is configured to connect to at least one gas removing device within a gas formation.

17. The downhole isolator according to claim 13 wherein said by-pass gas transport includes an upper ring member that maintains the position of the tubing within the sleeve member.

* * * * *